US006321543B1

(12) United States Patent
Said et al.

(10) Patent No.: US 6,321,543 B1
(45) Date of Patent: Nov. 27, 2001

(54) METHOD FOR PROTECTING COMPRESSORS USED IN CHILLERS AND/OR HEAT PUMPS

(75) Inventors: Wahl Said, Lyons; Hippolyte Chavagnat, Montluel Cedex, both of (FR)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 09/526,074

(22) Filed: Mar. 15, 2000

(51) Int. Cl.[7] ..... F25B 7/00; F25B 41/00
(52) U.S. Cl. ..... 62/81; 62/156; 62/175
(58) Field of Search ..... 62/175, 81, 156, 62/278.3, 228.1, 70

(56) References Cited

U.S. PATENT DOCUMENTS 4,831,834 * 5/1989 Yoshida ..... 62/228.1
5,797,729 * 8/1998 Rafuse, Jr. et al. ..... 417/3
5,806,327 * 9/1998 Lord et al. ..... 62/115

* cited by examiner

*Primary Examiner*—William Wayner
(74) *Attorney, Agent, or Firm*—Wall Marjama & Bilinski

(57) ABSTRACT

A controller monitors the saturated suction temperature and the saturated discharge temperature of a system that includes a compressor operating as part of a chiller and/or heat pump. When the compressor operates outside its compressor map, the controller takes action to ensure the compressor operates only within its compressor map. Such actions include defrosting the compressor coil if the system is in heating mode or unloading the unit.

5 Claims, 2 Drawing Sheets

METHOD FOR PROTECTING COMPRESSORS USED IN CHILLERS AND/OR HEAT PUMPS

FIELD OF THE INVENTION

This invention pertains to the field of compressors used in chillers and/or heat pumps, and in particular, to protecting the compressor by keeping the compressor within its proper operating parameters.

BACKGROUND OF THE INVENTION

Heat pump systems use a refrigerant cycle to transfer heat (or energy) from a relatively cool side to a hotter side. At the cooler side, evaporation of the refrigerant occurs at a relatively low pressure. As a result, liquid is turned into vapor and heat is extracted from a media that can be air, water, brine, or even the ground. The generated vapor flows through one or more compressors where its pressure is raised. After leaving the compressor, the high pressure vapor flows into a condenser where it is turned into a liquid. At this stage, heat is released by the refrigerant into another media that can be air, water, brine, or the ground. The amount of heat released is roughly equal to the amount of heat extracted at the cooler side plus the amount of energy needed to drive the vapor refrigerant from the low pressure side (cool side) to the high pressure side (hotter side).

Because the refrigerant cycle in a heat pump can be reversed, the unit can be used for either heating or cooling. In principle, the refrigerant cycle for the two modes are comparable.

For heat pumps to operate efficiently, an adequate temperature difference must exist between the refrigerant and the medias (air, water, brine, or ground). From an efficiency standpoint, it is desirable that the heat pump deliver more energy (thermal) than it uses (electrical).

The heart of a heat pump or chiller system is the compressor. Each compressor type has an associated compressor map, i.e., an area function of saturated suction temperature and saturated discharge temperature. Manufacturers typically guarantee the reliability of the compressor if the compressor is operated within its compressor map. Unfortunately, compressors can operate outside their compressor map, unbeknownst to the user, until the compressor fails suddenly.

SUMMARY OF THE INVENTION

Briefly stated, a controller monitors the saturated suction temperature and the saturated discharge temperature of a system that includes a compressor operating as part of a chiller and/or heat pump. When the compressor operates outside its compressor map, the controller takes action to ensure the compressor operates only within its compressor map. Such actions include defrosting the compressor coil if the system is in heating mode or unloading the unit.

According to an embodiment of the invention, a method for protecting at least one compressor used in a heat pump or chiller system includes the steps of (a) determining a saturated suction temperature (SST) for the at least one compressor; (b) determining a saturated discharge temperature (SDT) for the at least one compressor; (c)providing first and second limits for the at least one compressor; (d) providing first and second specified performance margins for the at least one compressor wherein the first and second performance margins are related to the first and second limits; (e) determining, based on the first and second limits and the first and second performance margins, whether the at least one compressor is operating in a preferred zone, and if not, performing a subsequent action.

According to an embodiment of the invention, a method for protecting at least one compressor used in a heat pump or chiller system includes the steps of (a) determining a saturated suction temperature (SST) for the at least one compressor; (b) determining a saturated discharge temperature (SDT) for the at least one compressor; (c) providing first and second limits for the at least one compressor; (d) providing first and second specified performance margins for the at least one compressor wherein the first and second performance margins are related to the first and second limits; (e) comparing the SST to a specified temperature, and if the SST is less than the specified temperature, unloading, if present, one compressor from the system, and if the SST is not less than the specified temperature, comparing the SST to a sum of the first limit and the first performance margin; (f) determining, if the SST is not greater than the sum of the first limit and the first performance margin, whether the SST is greater than the first limit; (g) determining, if the SST is greater than the sum of the first limit and the first performance margin, whether frosting of a condenser coil is greater than a specified percentage, and if so, defrosting the coil, and if not, unloading, if present, one compressor from the system; (h) determining, if the SST is not greater than the first limit, whether a rate of change of the SDT is greater than a specified amount, and if not, periodically determining whether the rate of change of the SDT is greater than the specified amount, and if so, determining whether frosting of the coil is greater than the specified percentage, and if so, defrosting the coil, and if not, unloading, if present, one compressor from the system; and (i) determining, if the SST is greater than the first limit and the SST is not greater than the sum of the first limit and the first performance margin, whether the SDT is greater than a difference between the second limit and the second performance margin, and if so, forbidding compressor loading, and if not, allowing compressor loading if necessary.

DETAILED DESCRIPTION OF THE INVENTION

Although the invention can be applied to any kind of heat pump or chiller, the following explanation focuses mainly on an air to water heat pump.

Figure 1:
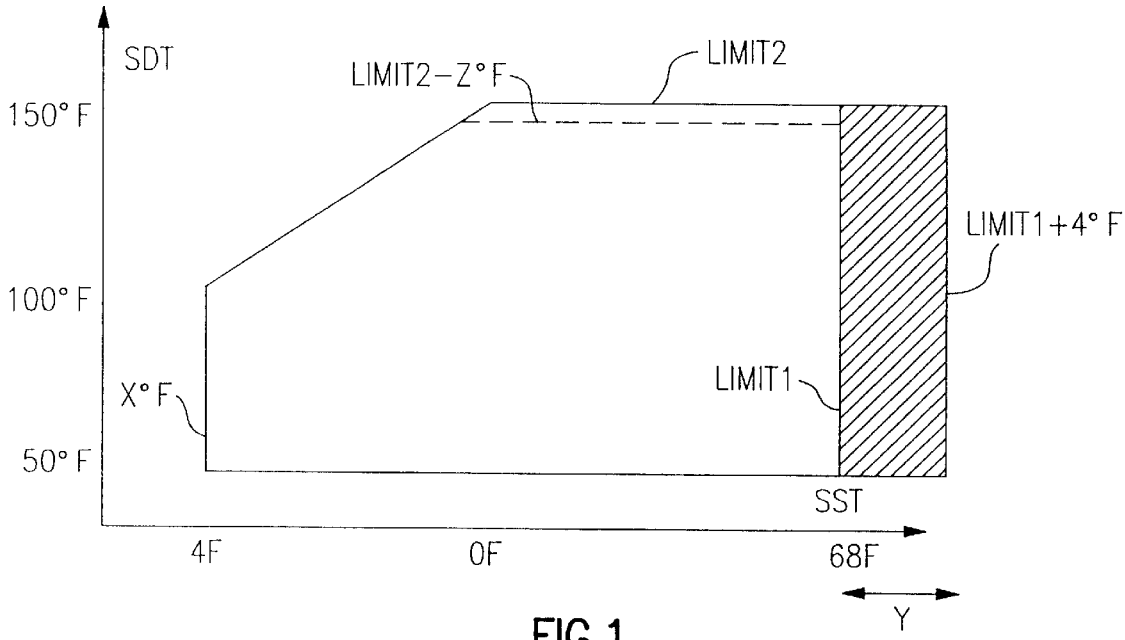
FIG. 1 shows a typical compressor map.

Referring now to FIG. 1, a typical compressor map shows an operating area within the parameters of SST (saturated suction temperature) and SDT (saturated discharge temperature). The area bounded by the lines is the safe operating area for a given compressor.

Figure 2:
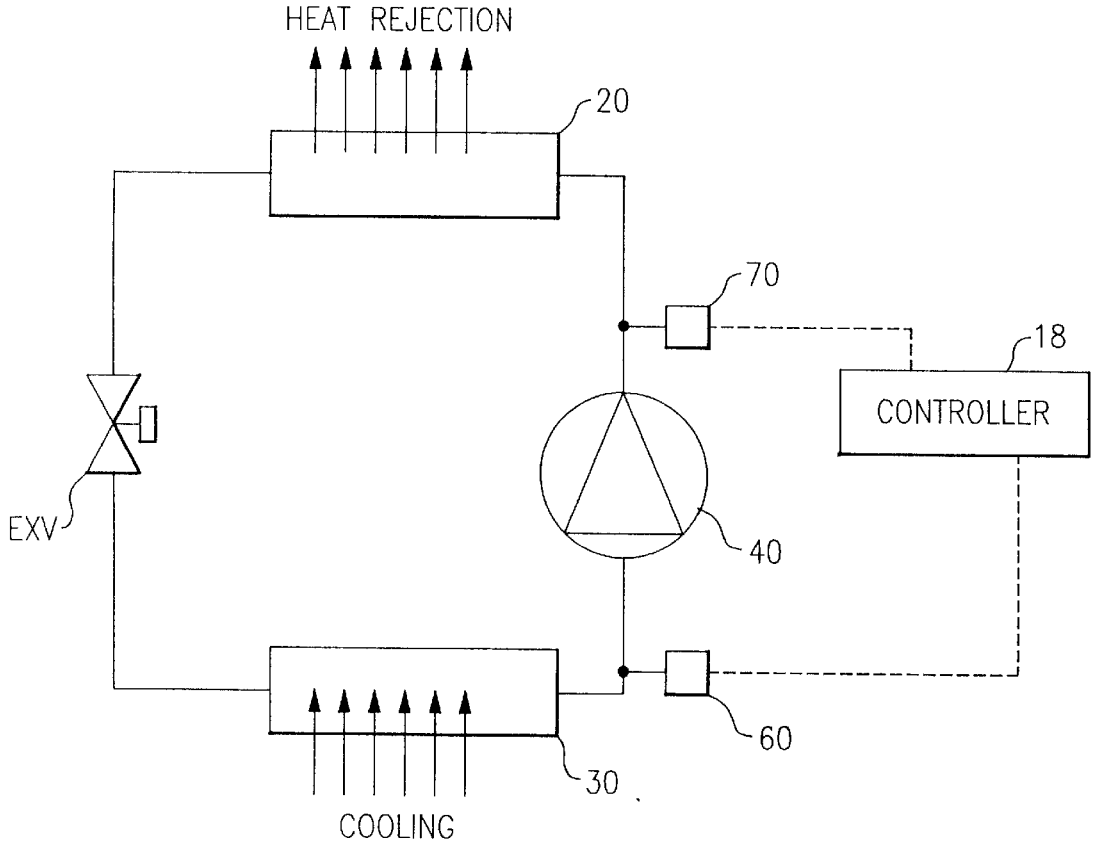
FIG. 2 shows a simplified schematic of a chiller circuit.

Referring to FIG. 2, a condenser 20 is fluidly connected to an evaporator 30 via an electronic expansion valve EXV. Vapor from evaporator 30 travels to a compressor 40 where the vapor is liquefied and pressurized before entering condenser 20. A transducer 60, preferably a suction pressure transducer, determines a suction pressure and converts the suction pressure to the saturated suction temperature SST based on the known simple linear relationship between saturated pressure and saturated temperature. A transducer

70, preferably a discharge pressure transducer, determines a discharge pressure and converts the discharge pressure to the saturated discharge temperature SDT. Thermistors which read the appropriate temperatures directly are optionally used, but are not considered to be as accurate as the preferred pressure transducers. The SST and SDT are read by a controller 18. Controller 18 can be a microcontroller or CPU, which can be preprogrammed for a specific compressor or optionally programmed for different compressors as necessary.

Figure 3:
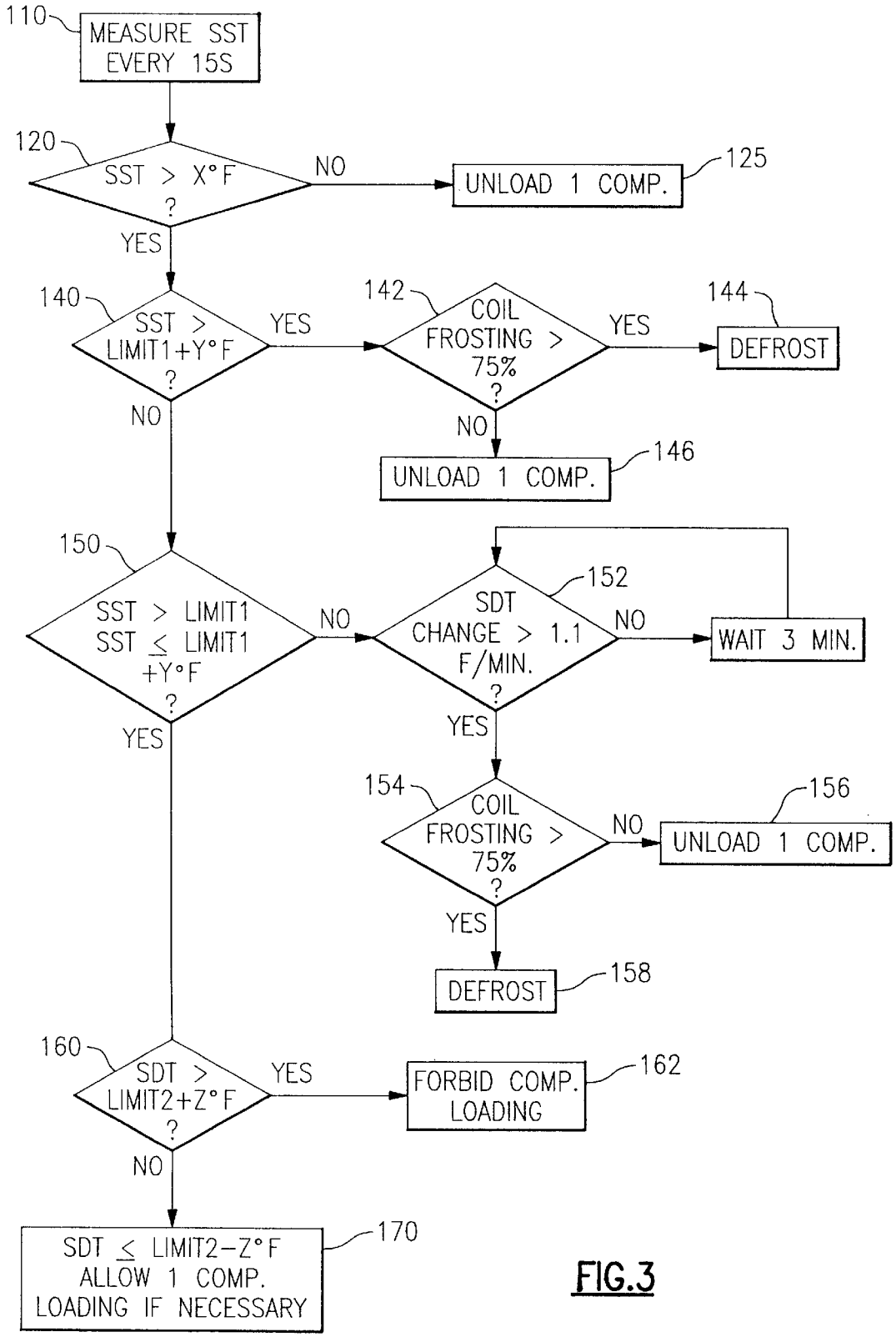
FIG. 3 shows a modified flow chart according to the method of the present invention.

Referring to FIG. 3, the SST and SDT as read by controller 18 are processed according to the flow chart depicted. The SST is measured every 15 seconds in step 110. The SST is compared to a given temperature, shown as "X" in step 120, provided by the compressor manufacturer based on the compressor map for the particular unit being controlled. Values depicted as "limit1", "limit2", "Y" (steps 140, 150) and "Z" (steps 160, 170) are also based on the compressor map. For example, for Carrier Corporation model numbers 30RH 17/21/26/33/40/50/60/70/80/90/100/120/140/160/200/240, limit1=68° F., limit2=150° F., X=−4° F.; Y=10° F.; and Z=2° F. Thus, the safe performance margins for these model numbers are limit2−Z=148° F. and limit1+Y=78° F. If the SST is less than or equal to X° F., one compressor is unloaded in step 125. If the SST is greater than X° F., another check is made to see if the SST is greater than limit1 by a certain amount, "Y", as shown in step 140. If yes, coil frosting is checked in step 142 as described in U.S. patent application Ser. No. 09/525,348, filed Mar. 15, 2000 and entitled, METHOD AND SYSTEM FOR DEFROST CONTROL ON REVERSIBLE HEAT PUMPS, incorporated herein by reference. If coil frosting is greater than 75%, the coil is defrosted as shown in step 144. If coil frosting is less than 75%, one compressor is unloaded as shown in step 146.

If the SST is not greater than limit1+Y° F. in step 140, the SST is checked in step 150 to see if the SST is still greater than limit1. If not, the rate of change of the SDT is checked in step 152 to see if it is greater than a specified amount, such as, for example, 1.1° F./min. The exact value depends on the compressor(s) being controlled. If the rate of change is greater than 1.1° F./min, the degree of coil frosting is checked in step 154. If the rate of change is not greater than 1.1° F./min, the rate of change is checked again in a specified time, shown in FIG. 3 as three minutes. If the degree of coil frosting in step 154 is greater than 75%, the coil is defrosted in step 158; otherwise, one compressor is unloaded in step 156.

If the SST is less than limit1, that is, if the compressor is operating within its normal SST range, the SDT is checked in step 160 to see if it is greater than limit2 minus a safety margin "Z." If yes, compressor loading is forbidden in step 162. Otherwise, it is safe to allow compressor loading if necessary as shown in step 170.

The present invention thus ensures that the compressor operates within the compressor map and thus are covered by the manufacturer's guarantee provisions guaranteeing the compressor's lifespan and reliability.

While the present invention has been described with reference to a particular preferred embodiment and the accompanying drawings, it will be understood by those skilled in the art that the invention is not limited to the preferred embodiment and that various modifications and the like could be made thereto without departing from the scope of the invention as defined in the following claims.

While the present invention has been particularly shown and described with reference to the preferred mode as illustrated in the drawing, it will be understood by one skilled in the art that various changes in detail may be effected therein without departing from the spirit and scope of the invention as defined by the claims.

We claim:

1. A method for protecting at least one compressor used in a heat pump or chiller system, comprising the steps of:

determining a saturated suction temperature (SST) for said at least one compressor;

determining a saturated discharge temperature (SDT) for said at least one compressor;

providing first and second limits for said at least one compressor;

providing first and second specified performance margins for said at least one compressor wherein said first and second performance margins are related to said first and second limits;

comparing said SST to a specified temperature, and if said SST is less than said specified temperature, unloading, if present, one compressor from said system, and if said SST is not less than said specified temperature, comparing said SST to a sum of said first limit and said first performance margin;

determining, if said SST is not greater than said sum of said first limit and said first performance margin, whether said SST is greater than said first limit;

determining, if said SST is greater than said sum of said first limit and said first performance margin, whether frosting of a condenser coil is greater than a specified percentage, and if so, defrosting said coil, and if not, unloading, if present, one compressor from said system;

determining, if said SST is not greater than said first limit, whether a rate of change of said SDT is greater than a specified amount, and if not, periodically determining whether said rate of change of said SDT is greater than said specified amount, and if so, determining whether frosting of said coil is greater than said specified percentage, and if so, defrosting said coil, and if not, unloading, if present, one compressor from said system; and determining, if said SST is greater than said first limit and said SST is not greater than said sum of said first limit and said first performance margin, whether said SDT is greater than a difference between said second limit and said second performance margin, and if so, forbidding compressor loading, and if not, allowing compressor loading if necessary.

2. A method according to claim 1, wherein:

said first performance margin is 10 degrees F.; and said second performance margin is 2 degrees F.

3. A method for protecting at least one compressor used in a heat pump or chiller system, comprising the steps of:

determining a saturated suction temperature (SST) for said at least one compressor;

determining a saturated discharge temperature (SDT) for said at least one compressor;

providing first and second limits for said at least one compressor;

providing first and second specified performance margins for said at least one compressor wherein said first and second performance margins are related to said first and second limits;

determining, based on said first and second limits and said first and second performance margins, whether said at least one compressor is operating in a preferred zone, and if not, performing a subsequent action.

4. A method according to claim 3, wherein said step of determining whether said at least one compressor is operating in a preferred zone further comprises:

comparing said SST to a specified temperature, and if said SST is less than said specified temperature, unloading, if present, one compressor from said system, and if said SST is not less than said specified temperature, comparing said SST to a sum of said first limit and said first performance margin;

determining, if said SST is not greater than said sum of said first limit and said first performance margin, whether said SST is greater than said first limit;

determining, if said SST is greater than said sum of said first limit and said first performance margin, whether frosting of a condenser coil is greater than a specified percentage, and if so, defrosting said coil, and if not, unloading, if present, one compressor from said system;

determining, if said SST is not greater than said first limit, whether a rate of change of said SDT is greater than a specified amount, and if not, periodically determining whether said rate of change of said SDT is greater than said specified amount, and if so, determining whether frosting of said coil is greater than said specified percentage, and if so, defrosting said coil, and if not, unloading, if present, one compressor from said system; and determining, if said SST is greater than said first limit and said SST is not greater than said sum of said first limit and said first performance margin, whether said SDT is greater than a difference between said second limit and said second performance margin, and if so, forbidding compressor loading, and if not, allowing compressor loading if necessary.

5. A method according to claim 3, wherein:

said first performance margin is 10 degrees F.; and said second performance margin is 2 degrees F.

* * * * *